United States Patent [19]

Kovac

[11] 4,173,839

[45] Nov. 13, 1979

[54] AERODYNAMIC TOY

[76] Inventor: M. Jane Kovac, 1679 Elbur Ave., Lakewood, Ohio 44107

[21] Appl. No.: 861,647

[22] Filed: Dec. 19, 1977

[51] Int. Cl.[2] ..... A63H 33/18

[52] U.S. Cl. ..... 46/74 D

[58] Field of Search ..... 46/74 D; 273/106 B

[56] References Cited

U.S. PATENT DOCUMENTS

| | | | |
|---|---|---|---|
| 3,900,986 | 8/1975 | Torres | 46/74 D |
| 4,115,946 | 9/1978 | Vukmirovich | 46/74 D |

*Primary Examiner*—Louis G. Mancene
*Assistant Examiner*—Robert F. Cutting
*Attorney, Agent, or Firm*—Thomas N. Neiman

[57] ABSTRACT

This invention is a disc-type, aerodynamic toy. This toy consists of a fabric center which can be altered by the owner to varying thicknesses and degrees of coverage for aerodynamic purposes. The fabric center is bounded by a rim into which the center is pressed. A smooth convex surface surrounds the center and rim. The smooth convex surface is bordered by a lip which is turned inwardly toward the center of the toy. The smooth surface combined with the heavy center of varying thickness, and degree of coverage, makes the toy extremely stable, a toy which the owner can alter to suit his or her aerodynamic requirements.

9 Claims, 3 Drawing Figures

AERODYNAMIC TOY

This invention pertains to toys and in particular to disc-type, throwing, aerodynamic toys. The large number of toys of this type is readily apparent to anyone familiar with recreational sites, such as beaches, parks, or school playgrounds. Toys of this type are usually made of a single molded plastic disc with circular, raised ribs on the convex side of the disc. Typically they are thrown or launched for "flight" by gripping the disc with the thumb on the convex side and with one or more fingers on the concave surface of the unit. It is thrown by using an underhanded or sidearm motion with a snapping motion of the wrist. This causes a spinning motion and the direction of flight is determined by the angle at which the disc is released compared to the horizontal plane.

The typical flying disc type units are designed with a number of circular, raised ribs spaced on the convex side of the unit. These ribs are placed on the unit to create turbulence on the convex side which will decrease pressure on that side and create a lifting action. These units are typically thin in the center sections and thicker on the outside rim. Examples of this type invention include "Flying Saucer", U.S. Pat. No. 3,359,678, issued to Edward E. Hendrick on Dec. 26, 1967 and "Aerodynamic Orificed Disc", U.S. Pat. No. 4,045,029, issued to Peter C. Katzmark on Aug. 30, 1977.

It is an object of this invention to improve the above-mentioned patented devices by replacing the plastic center sections thereof with a fabric screen material which is impregnated or bonded into an outside rim. The convex outer surface from this rim to the perimeter of the toy is smooth. The outside perimeter is in the form of a lip which is bent invardly. The toy is provided with material to stitch in the center section. The exact flight characteristics will depend on the amount of center area that is covered by stitching and the type of cross-stitching used. When the entire surface is covered, the greatest distance can be achieved. Varying degrees of control accuracy and distance can be achieved by the owner depending on what particular goal is desired. In addition, an imprinted design on the fabric or any innovative scene can be stitched in the toy. The center is the thickest and heaviest section of the toy (when completely overlaid with stitching) and this feature, combined with the smooth, uninterrupted convex surface enhances the strength of the toy and causes it to fly smoother (less oscillation), quicker, and more accurately than conventional disc-type, aerodynamic toys.

It is a further object of this invention to teach a flight-stable aerodynamic toy comprising a body element having an annular center section; a flexible fabric material fixed in said center section; a rim bounding said center section; a convex wall bounding said rim and means joined to said wall and cooperative therewith to define a reentrant-type cavity, having a greater transverse dimension therewithin than at the entry of said cavity to cause said cavity to retain flight sustaining air therewithin.

Further objects of this invention, as well as the novel features thereof, will become apparent by reference to the following figures, in which.

Figure 1:
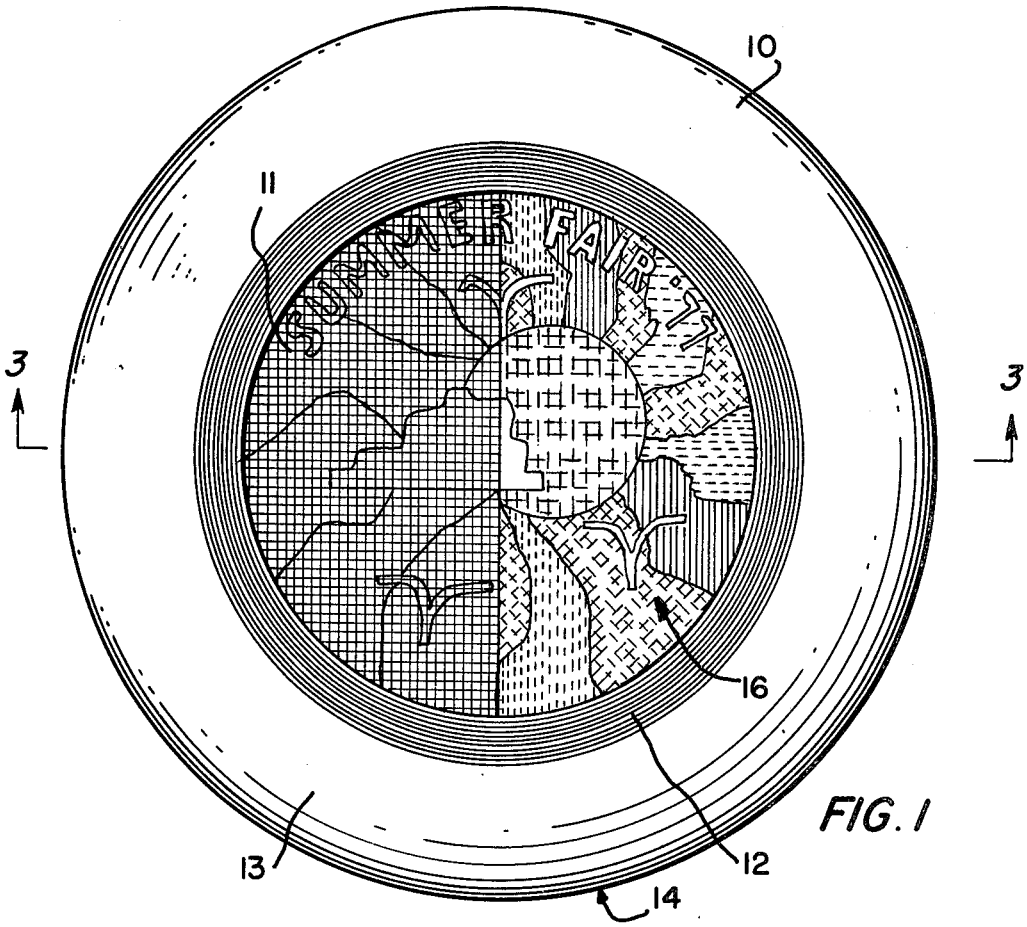
FIG. 1 is a top view of an embodiment of the novel aerodynamic toy.

As shown in FIG. 1, the aerodynamic toy comprises a disc 10 having a fabric center section 11 bounded by a thick rim 12 into which the fabric center 11 is impregnated or bonded. This rim 12 is surrounded by a convex smooth surface 13. This convex smooth surface 13 is bounded by and is joined to an outer lip 14 which is turned inwardly (as shown in FIG. 3).

Figure 2:
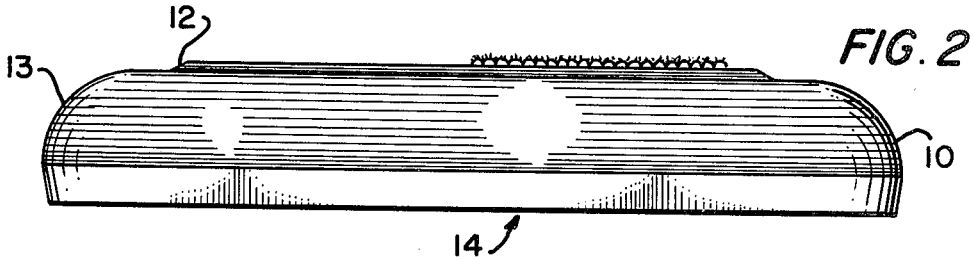
FIG. 2 is a side view thereof.

FIG. 2 is a side view which shows the curvature and the uninterrupted nature of the convex smooth surface 13 and the inward angle of the lip 14.

Figure 3:
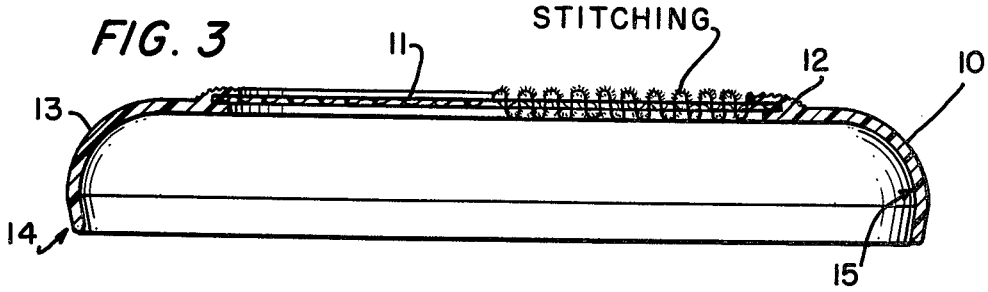
FIG. 3 is a cross-sectional view thereof, taken along section 3—3 of FIG. 1.

FIG. 3 is a diametrical cross-sectional view of the disc 10 which illustrates how the fabric center 11 is impregnated or bonded into the rim 12. This figure also shows the inner concave surface 15.

The center section 11 can be stitched or needle-pointed to a design which may be imprinted on the fabric, as shown on one side 16 of the center section 11, or an original design can be stitched. The different type stitches used will affect the flight characteristics as will the different thicknesses of the material used in the stitching. It should be noted that the center section 11 can be left unstitched and it will have specific flight characteristics of its own. The concentrated weight of the center section 11 (when the stitching is completed) and the thicker rim 12 surrounding it cause the disc 10 to be less pliable and therefore, stronger. The smooth convex surface 13 has no protuberances and results in quieter, smoother (less oscillation), and more accurate flight. The lip 14 is turned inwardly to give the disc 10 a greater stability by retaining an air cushion therein.

It should be noted that it will be self-evident to those skilled in the art that various designs and stitches can be used. There is a potential for specialty advertising to be applied by stitching to the fabric area. Various fabric type materials can be used in the center section and different curvatures can be used for the surfaces 13 and 14. All such variations and/or modifications are deemed to be within the ambit of my invention.

Accordingly, while I have described my invention in connection with a specific embodiment thereof, it is clearly to be understood that this is done only by way of example and not as a limitation to the scope of my invention as set forth in the objects thereof and in the appended claims.

I claim:

1. A flight-stable, aerodynamic toy, comprising:
a body element having an annular center section;
a flexible fabric material fixed in said center section;
a rim bounding said center section;
a convex wall bounding said rim;
said rim being tangential to said convex wall; and
means joined to said wall and cooperative therewith to define a reentrant-type cavity, having a greater transverse dimension therewithin than at the entry of said cavity, to cause said cavity to retain flight-sustaining air therewithin; wherein
said convex wall defines a convex surface which is smooth and devoid of any air-flow-disturbing protuberances and discontinuities;
said wall has a given thickness; and
said rim has a thickness greater than said given thickness, to rigidize and to lend hoop strength to said center section.

2. A toy, according to claim 1, wherein: